US009287640B2

(12) United States Patent
Hirschy

(10) Patent No.: US 9,287,640 B2
(45) Date of Patent: Mar. 15, 2016

(54) COMPLIANT PIN WITH IMPROVED INSERTION CAPABILITIES

(71) Applicant: Molex Incorporated, Lisle, IL (US)

(72) Inventor: Christopher D. Hirschy, Conway, AR (US)

(73) Assignee: Molex, LLC, Lisle, IL (US)

( * ) Notice: Subject to any disclaimer, the term of this patent is extended or adjusted under 35 U.S.C. 154(b) by 17 days.

(21) Appl. No.: 13/739,627

(22) Filed: Jan. 11, 2013

(65) Prior Publication Data

US 2014/0199862 A1 Jul. 17, 2014

(51) Int. Cl.

| | |
|---|---|
| ***H01R 12/00*** | (2006.01) |
| ***H01R 12/58*** | (2011.01) |
| *H01R 13/6594* | (2011.01) |

(52) U.S. Cl.

CPC ..... *H01R 12/585* (2013.01); *H01R 13/6594* (2013.01)

(58) Field of Classification Search

CPC ..... H01R 12/585; H01R 9/091
USPC ..... 439/84, 607, 541.5
See application file for complete search history.

(56) References Cited

U.S. PATENT DOCUMENTS

| | | | | |
|---|---|---|---|---|
| 4,923,414 | A * | 5/1990 | Sitzler | 439/751 |
| 7,070,446 | B2 * | 7/2006 | Henry et al. | 439/541.5 |
| 7,226,314 | B2 * | 6/2007 | Lang et al. | 439/607.04 |
| 7,344,409 | B2 * | 3/2008 | Lang et al. | 439/607.04 |
| 7,357,673 | B2 * | 4/2008 | Long | 439/607.2 |
| 7,491,089 | B2 * | 2/2009 | Lang et al. | 439/607.01 |
| 7,641,515 | B1 * | 1/2010 | Szczesny et al. | 439/607.01 |
| 7,727,018 | B2 * | 6/2010 | Bright et al. | 439/607.28 |
| 7,845,975 | B2 * | 12/2010 | Cheng et al. | 439/541.5 |
| 7,862,376 | B2 * | 1/2011 | Sypolt et al. | 439/607.07 |
| 8,342,881 | B2 * | 1/2013 | Lang et al. | 439/607.01 |
| 8,657,631 | B2 * | 2/2014 | Lang et al. | 439/660 |
| 8,740,646 | B2 * | 6/2014 | Lang et al. | 439/607.01 |
| 2006/0189212 | A1 * | 8/2006 | Avery et al. | 439/608 |
| 2008/0220665 | A1 | 9/2008 | Darr et al. | |
| 2009/0170373 | A1 * | 7/2009 | Pan | 439/607.36 |
| 2011/0300757 | A1 * | 12/2011 | Regnier et al. | 439/626 |
| 2012/0034820 | A1 * | 2/2012 | Lang et al. | 439/660 |

* cited by examiner

*Primary Examiner* — Abdullah Riyami
*Assistant Examiner* — Vladimir Imas
(74) *Attorney, Agent, or Firm* — Stephen L. Sheldon

(57) ABSTRACT

A compliant pin for use with a shielding cage or electrical connector is disclosed that has improved insertion capabilities that increase the resistance of the compliant pin to buckling during mounting of the cage or connector to a circuit board. The pin has a base and tip portion that are interconnected together by a body portion. An opening is disposed in the pin body portion and the top edge of the opening is positioned at a level therein that is spaced apart from and beneath the top surface of the circuit board. In another embodiment, the pin opening is generally non-symmetrical with a configuration that approximates a triangle, i.e., the wider base portion of the pin opening is closer to the pin tip portion than the narrower, apex portion of the pin opening.

20 Claims, 8 Drawing Sheets

COMPLIANT PIN WITH IMPROVED INSERTION CAPABILITIES

BACKGROUND OF THE PRESENT DISCLOSURE

The Present Disclosure relates generally to board mounted connectors, and more particularly, to such connectors having improved compliant mounting pins that offer beneficial insertion and retention capabilities.

Many electronic devices utilize internal circuit boards for circuitry and as a platform upon which to mount integrated circuits, switches, components and the like, including connectors. These connectors are often surrounded with a conductive shielding member that takes the form of a cage to provide grounding and shielding against electromagnetic interference radiation, known as "EMI." These shields may be mounted to the surface of the circuit board, such as by soldering, or they may be provided with a plurality of members in the form of mounting pins that extend downwardly therefrom and which are received in openings formed in the circuit board. These openings are formed as plated through holes, or "vias," directly in the circuit board and have a conductive metal plating applied to their inner surfaces, or sidewalls. The pins are formed as compliant members and are known in the art as press-fit pins or compliant pins. These pins are larger in overall size than the holes and this dimensional difference permits the pins to firmly engage the sidewalls of the holes and thereby form an electrical connection between the cage and the circuit boards. In addition to their use with shielding cages, compliant pins may also be used with electrical connectors for the same mounting purpose, and may be used directly as terminal tail portions in both connectors and other electronic components, such as switches, integrated circuits and the like.

There are problems in the use of press-fit compliant pins and these problems include inadequate performance during insertion into and retention by a circuit board. The cross-section of some pins may be lacking in structural integrity such that those pins may bend or buckle when the pins are inserted into their associated through holes. If the pins buckle during insertion they will not be fully inserted into the holes and may deform more than expected. This lack of full insertion and/or excessive deformation negatively affects the electrical contact between the pins and the surrounding vias and requires the cage to be removed and replaced, but in doing so, the buckled configuration of the pins may give rise to the possibility of damage to the expensive circuit board.

Similarly, if the pins buckle during insertion, they may provide adequate electrical contact with the circuit board but their retention capability may be diminished to the point where the electrical contact becomes sporadic and intermittent after the device in which the cage is used proceeds through assembly, packing, shipping and installation at an end user. This intermittent contact may not be discovered until the product is placed into service at the end user or shortly thereafter, thereby necessitating return of the device to the manufacturer.

The Present Disclosure is therefore directed to a compliant pin having an improved structure that offers greater resistance to buckling.

SUMMARY OF THE PRESENT DISCLOSURE

Accordingly, there is provided an improved compliant pin that has a cross-section configured to better resist buckling during insertion into a circuit board opening.

In accordance with a first embodiment as described in the following Present Disclosure, a compliant pin particularly suitable for use in association with a conductive shielding cage is provided with an elongated body which has an internal opening, or "eye," positioned within the pin body at a level beneath the circuit board-cage interface so that more material is present in this area which enhances the resistance to buckling of the compliant pin upon insertion and removal.

In accordance with a second embodiment as described in the Present Disclosure, a non-symmetrical opening is formed in the pin body. The opening is symmetrical around a vertical axis, but not around an associated horizontal axis. As such, the opening has a given width at its upper extent that increases along the depth of the pin body so that the width of the bottom of the pin opening is wider, or larger, than that at the top of the pin opening and this larger opening is located below the circuit board-cage interface. More material is thus present in the upper portions of the pin body, and as such, the pin body has a greater moment of inertia and therefore a greater resistance to bending and buckling.

These and other objects, features and advantages of the Present Disclosure will be clearly understood through a consideration of the following detailed description.

BRIEF DESCRIPTION OF THE FIGURES

The organization and manner of the structure and operation of the Present Disclosure, together with further objects and advantages thereof, may best be understood by reference to the following Detailed Description, taken in connection with the accompanying Figures, wherein like reference numerals identify like elements, and in which.

DESCRIPTION OF THE PREFERRED EMBODIMENTS

Figure 1:
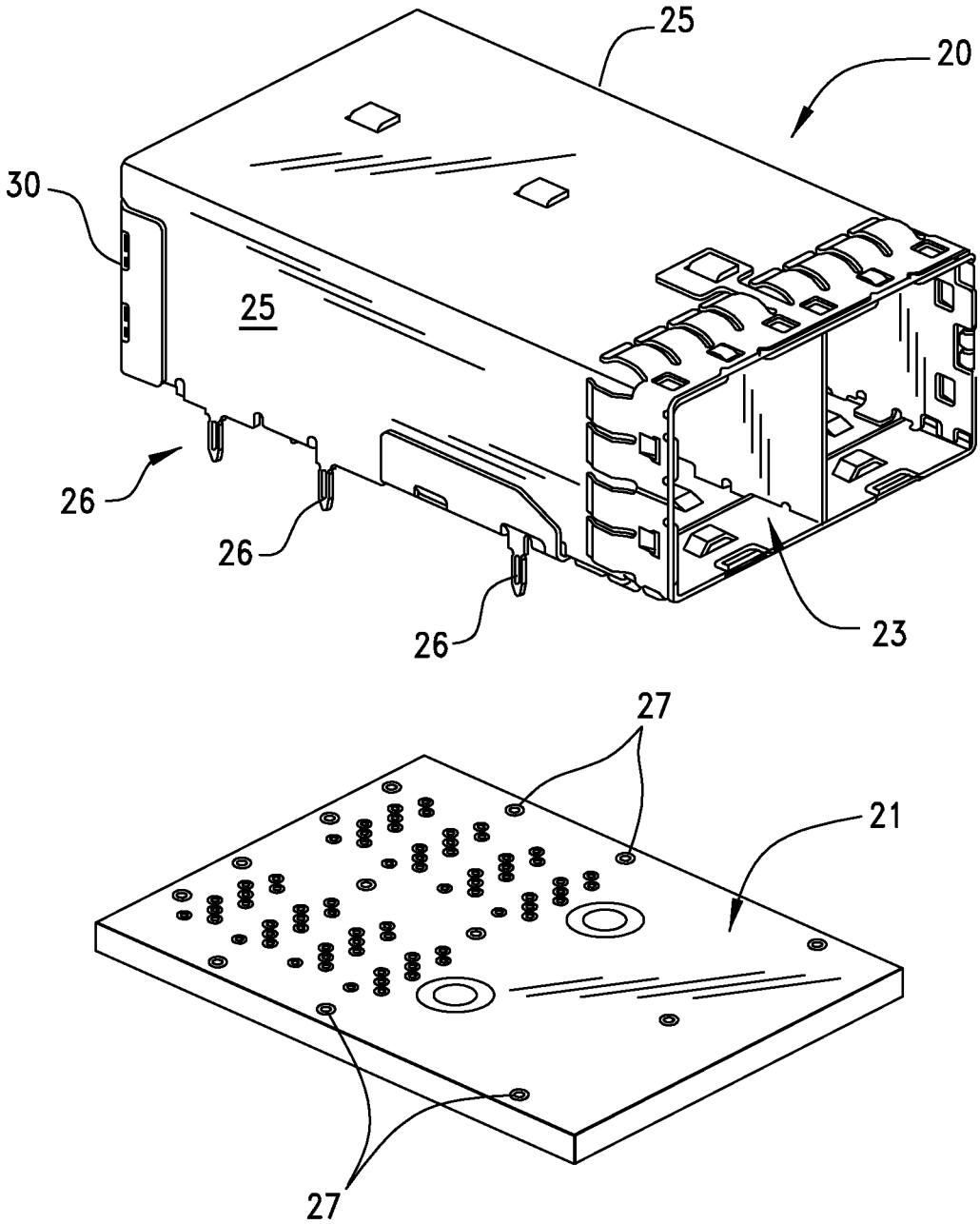
FIG. 1 is a perspective view of a shielding cage with compliant pins in accordance with the principles of the Present Disclosure and shown mounted to a circuit board.
Figure 2:
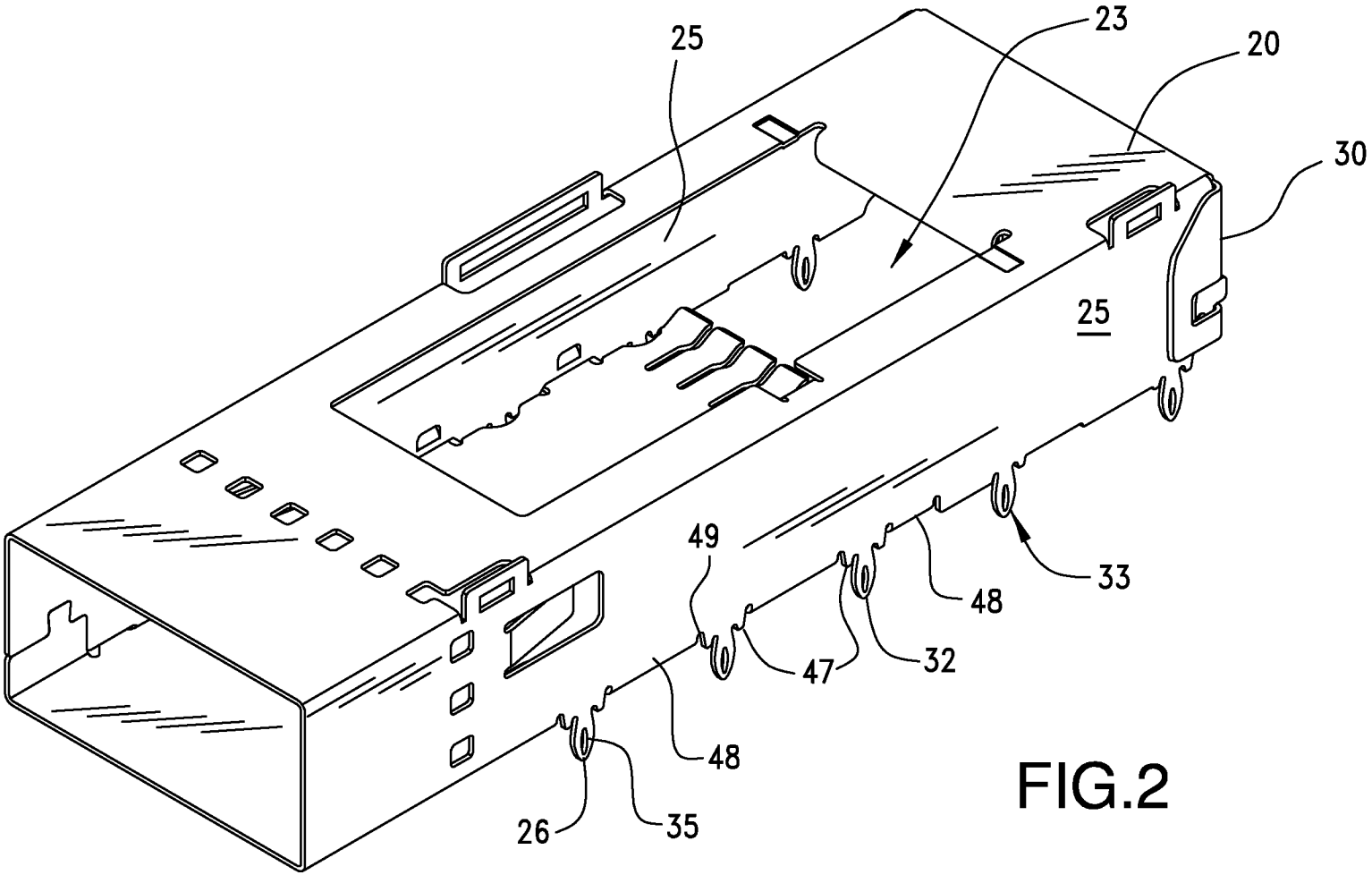
FIG. 2 is a perspective view of the shielding cage of FIG. 1 removed from the circuit board.

While the Present Disclosure may be susceptible to embodiment in different forms, there is shown in the Figures, and will be described herein in detail, specific embodiments, with the understanding that the Present Disclosure is to be considered an exemplification of the principles of the Present Disclosure, and is not intended to limit the Present Disclosure to that as illustrated.

As such, references to a feature or aspect are intended to describe a feature or aspect of an example of the Present Disclosure, not to imply that every embodiment thereof must have the described feature or aspect. Furthermore, it should be noted that the description illustrates a number of features. While certain features have been combined together to illustrate potential system designs, those features may also be used in other combinations not expressly disclosed. Thus, the depicted combinations are not intended to be limiting, unless otherwise noted.

In the embodiments illustrated in the Figures, representations of directions such as up, down, left, right, front and rear, used for explaining the structure and movement of the various elements of the Present Disclosure, are not absolute, but relative. These representations are appropriate when the elements are in the position shown in the Figures. If the description of the position of the elements changes, however, these representations are to be changed accordingly.

FIGS. 1-5B illustrate shielding cages 20 that incorporate compliant mounting pins constructed in accordance with the principles of the Present Disclosure. As can be seen in the Figures, the cage 20 is mounted to a circuit board 21 and has a hollow opening 23 that permits it enclose a connector 22, typically a receptacle connector, that has a slot disposed therein for receiving a mating blade of a plug connector (not shown) that is inserted into the interior of the cage 20. The cage is formed from a conductive material, typically metal, and may be mounted to the circuit board by way of a plurality of mounting members 24, shown formed integral with the sidewalls 25 of the cage 20. These mounting members 24 take the form of vertically extending pins and they are known in the art as "compliant" pins 26, which are inserted into a corresponding through hole, or via 27, formed in the circuit board. The compliant pins 26 have openings formed therein and the width of these pins in their associated body portions 36 is slightly bigger than the width of the vias 27. This is so that the pins 26 deform upon insertion into the circuit board vias 27 so as to make reliable contact with the inner surfaces 28 vias 27. The inner surfaces 28 of the vias 27 are plated with a conductive material to establish an electrical connection between the compliant pins 26 and the vias 27 and consequently to various circuits on the circuit board 21 that make contact with the interior plating of the vias 27.

Figure 3:
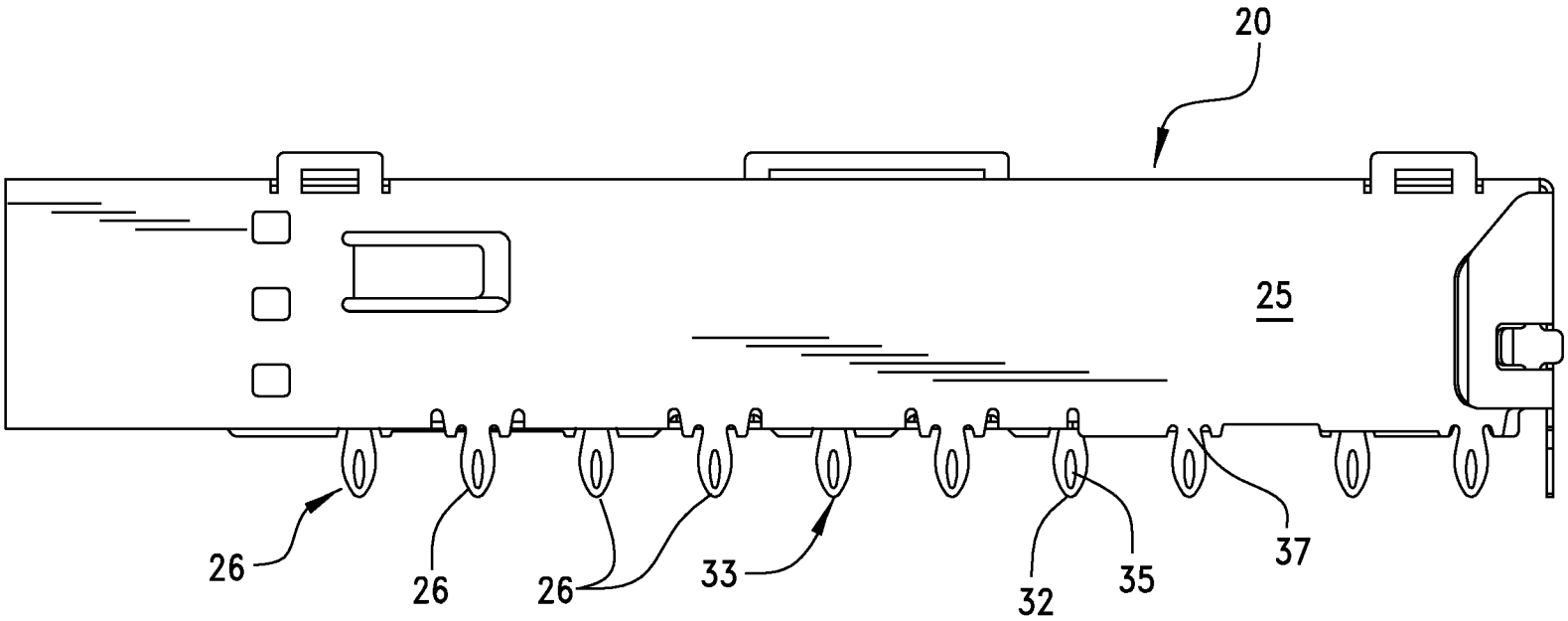
FIG. 3 is a side elevational view of the shielding cage of FIG. 1, but removed from the circuit board for clarity to illustrate the complaint mounting pins of the shielding cage.

The compliant pins 26 are arranged in a pattern around the outer edges 29 of the bottom of the shielding cage 20. Some of these pins 26 may be formed with the sidewalls 25 of the cage 20 while others may be formed as part of the endwall 30 of the shielding cage 20. The pattern of the compliant pins preferably is staggered as between the two rows of pins 26 depending down from the two opposing sidewalls 25 of the cage 20, as shown in FIG. 3. As shown best in FIGS. 3-4A, the pins 26 are preferably formed as part of the side and end walls 25, 30 of the cage 20 and have three distinct portions.

These distinct pin portions include a pin tip portion 32, which extends from the bottom end 33 of the compliant pin 26 to approximately the bottom edge 34 of a pin opening 35. A pin body portion 36 is disposed adjacent the pin tip portion 32, and it extends lengthwise along the pin 26 between the pin tip portion 32 and the pin base portion 37. As such, the pin body portion 36 extends along the outer edges 38 of the pin opening 35 and may be considered as at least partially enclosing the pin opening 35. The pin body portion 36 has a width greater than the widths of either the pin tip portion 32 or the pin base portion 37. This width varies along the length of the compliant pin 26.

Lastly, the pins 26 may also include a pin base portion 37 that extends down from the cage walls and joins the pin body portion 36 to the shielding cage walls (or in the case of a connector terminal, the terminal body portion). The pin base portion 37 extends to approximately the top edge 39 of the pin opening 35. The compliant pin base portion 37 may be partially separated from the cage walls 25, 30, illustrated by a pair of first slots 42, shown as reentrant notches 43 that extend upwardly with respect to the compliant pins 26. In the embodiment shown, these first slots 42 separate the pin base portions 37 from portions 45 of the sidewalls 25, shown as stubs or the like, and which may serve as "standoffs" 46 that make direct contact with the top surface 22 of the circuit board 21. These standoffs 46 serve as a point of direct contact "CI" with the circuit board 21 proximate to the compliant pin 26, and accordingly, each has a hard, substantially flat, or linear edge 47. This is in contrast to the approximate rounded edge 48 running the length of the sidewalls 25, obtained from the ordinary forming of the cage 20. A pair of second slots 49, also extending upwardly into the cage walls are shown as flanking the standoffs 46 and permit them to be formed so that they occupy a preferred perpendicular orientation to the circuit board top surface 22.

In an important aspect of the Present Disclosure, the pin opening 35 is disposed at a certain location within the pin body portion 36; specifically, at a level beneath the connector-cage interface (best shown by "CI" in FIG. 4A), in contrast to conventional compliant pin openings, where the pin opening 35 intersects with interface CI and extends upward above the top surface 22 of the circuit board 21. In the embodiment illustrated in FIGS. 4A-B, the pin opening 35 may have a conventional configuration such as the elongated oval or ellipse illustrated. By relocating the pin opening 35 to a location where it does not intersect the interface CI and where the pin opening 35 is disposed entirely beneath the top surface 22 of the circuit board 21, material is retained in the pin base portion 37 that ordinarily would be removed if the pin opening 35 were to intersect and extend past the interface line CI. This material makes the pin base portion 37 stronger and less susceptible to bending, and/or buckling upon insertion.

Figure 4A:
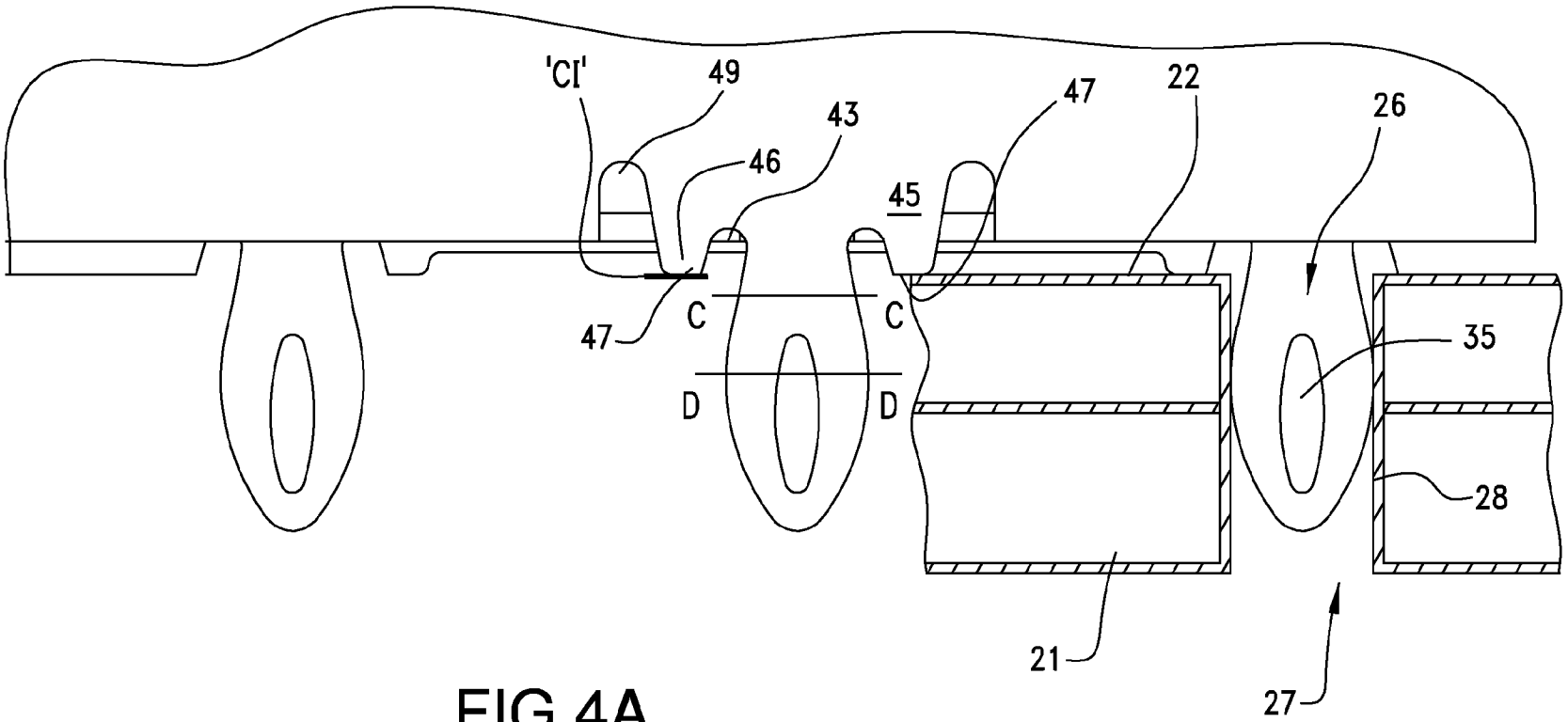
FIG. 4A is an enlarged view of a portion of the shielding cage of FIG. 1, which better illustrates a first embodiment of a compliant mounting pin constructed in accordance with the principles of the Present Disclosure.
Figure 4C:
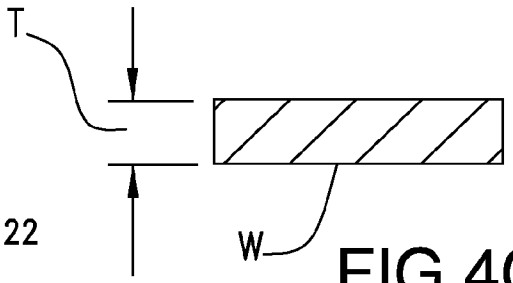
FIG. 4C is a diagrammatic view of a section through the pin base portion of the compliant pin of FIG. 4A, taken along Line C-C thereof, to illustrate geometry used to calculate the moment of inertia through a solid area of the pin base portion.
Figure 4D:
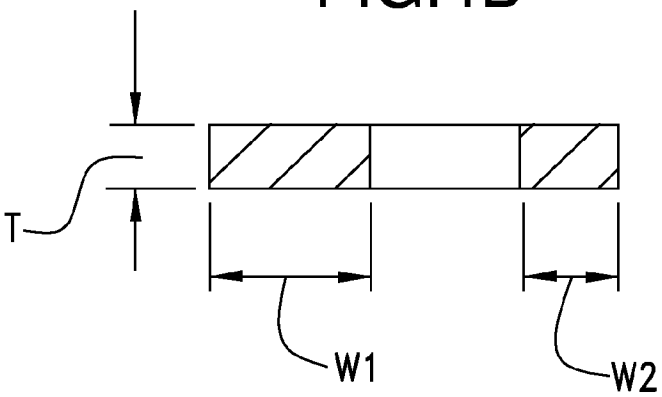
FIG. 4D is a diagrammatic view of a section through the pin base portion of the compliant pin of FIG. 4A, taken along Line D-D thereof, to illustrate the geometry used to calculate the moment of inertia through an area of the pin base portion which contains a pin opening.
Figure 4B:
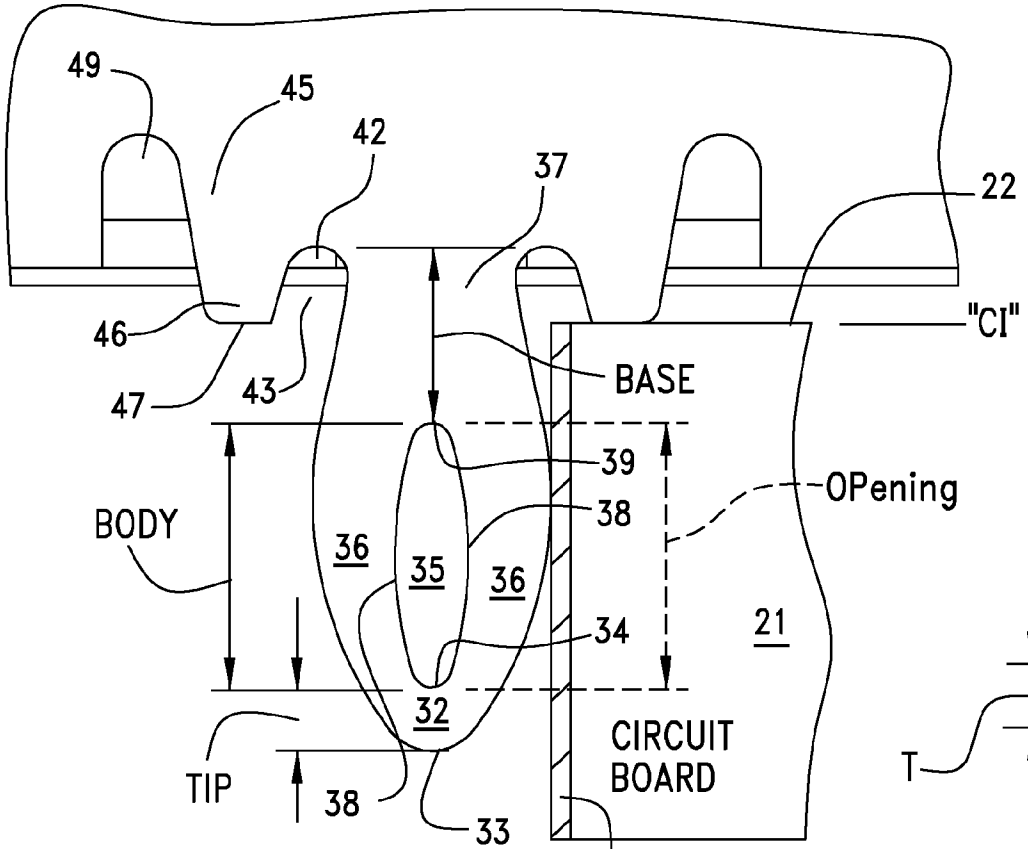
FIG. 4B is an enlarged detail view of FIG. 4A, illustrating a single compliant pin and it relation to a circuit board into which it is inserted.

The extra material in the pin base portion 37 increases the moment of inertia of the section taken through the pin base portion 37 and the section is a complete rectangle, having a width W and a thickness T as shown in FIG. 4C. Hence, the moment of inertia for such a section is 3 WT/12. The moment of inertia of this section is greater than the corresponding moment of inertia of the pin base portion of a conventional compliant pin where the pin opening extends into the pin base portion and which intersects the interface CI and extends above the level of the top surface 22 of the circuit board 21. Such a portion has a thickness T and two widths $W_1$ and $W_2$ as illustrated in FIG. 4D. The moment of inertia about a bending axis for this section is equal to the sum of the two solid sections, or $3\ W_1T/12+3\ W_2T/12$. In determining the bending stress of a member, the moment of inertia is used as a denominator in the bending stress formula; namely, $F=M_c/I$, and hence the larger the denominator (moment of inertia) becomes, the lower the bending stress. Thus, the increased resistance results from the material that replaces the pin opening along the interface CI and any other horizontal section in the pin base portion above the level on the top surface of the circuit board. This permits the overall width of the pin body portion to be increased with a larger degree of deformation during insertion, thereby improving insertion performance with less pin buckling.

Figure 5A:
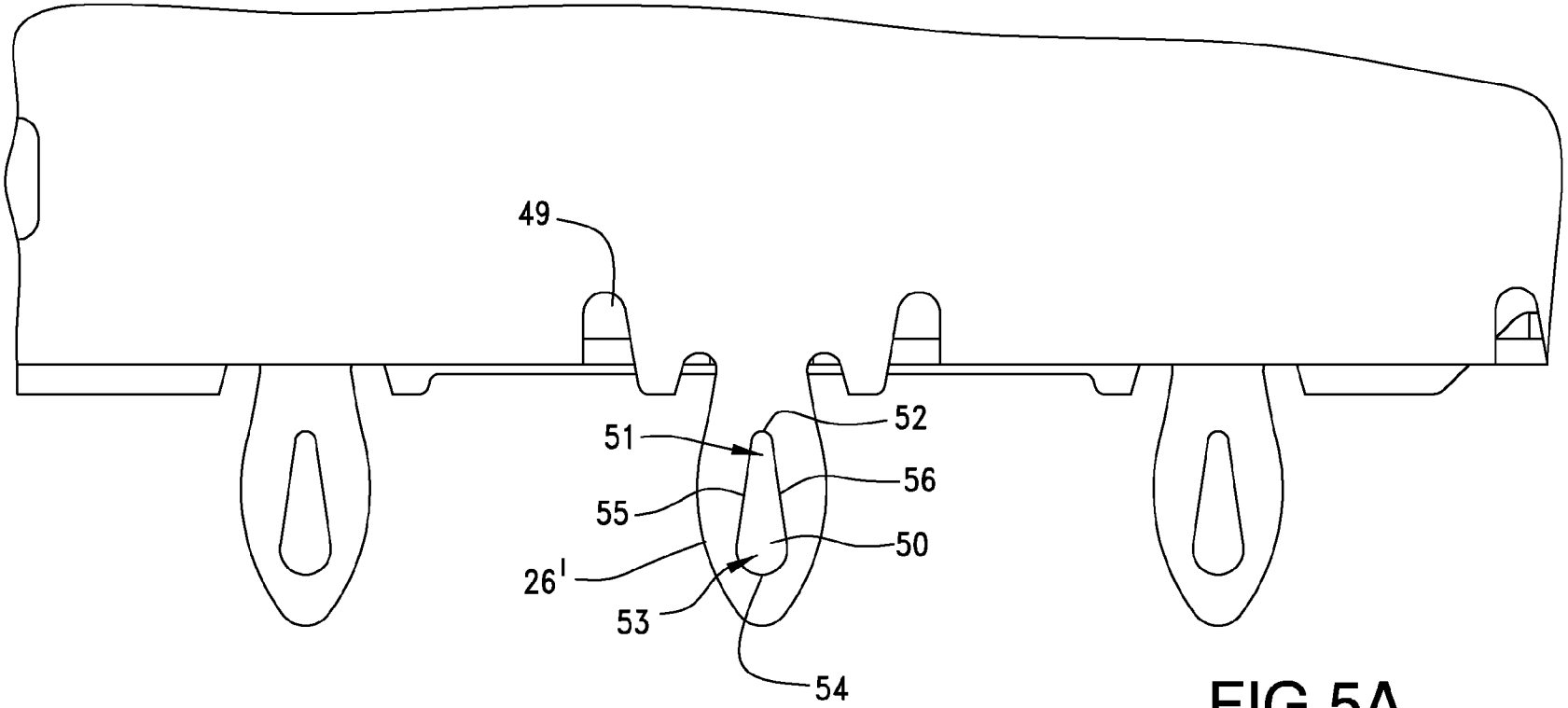
FIG. 5A is a side elevational view of a shielding cage, removed from a circuit board but which utilizes a second embodiment of a compliant pin constructed in accordance with the principles of the Present Disclosure.
Figure 5B:
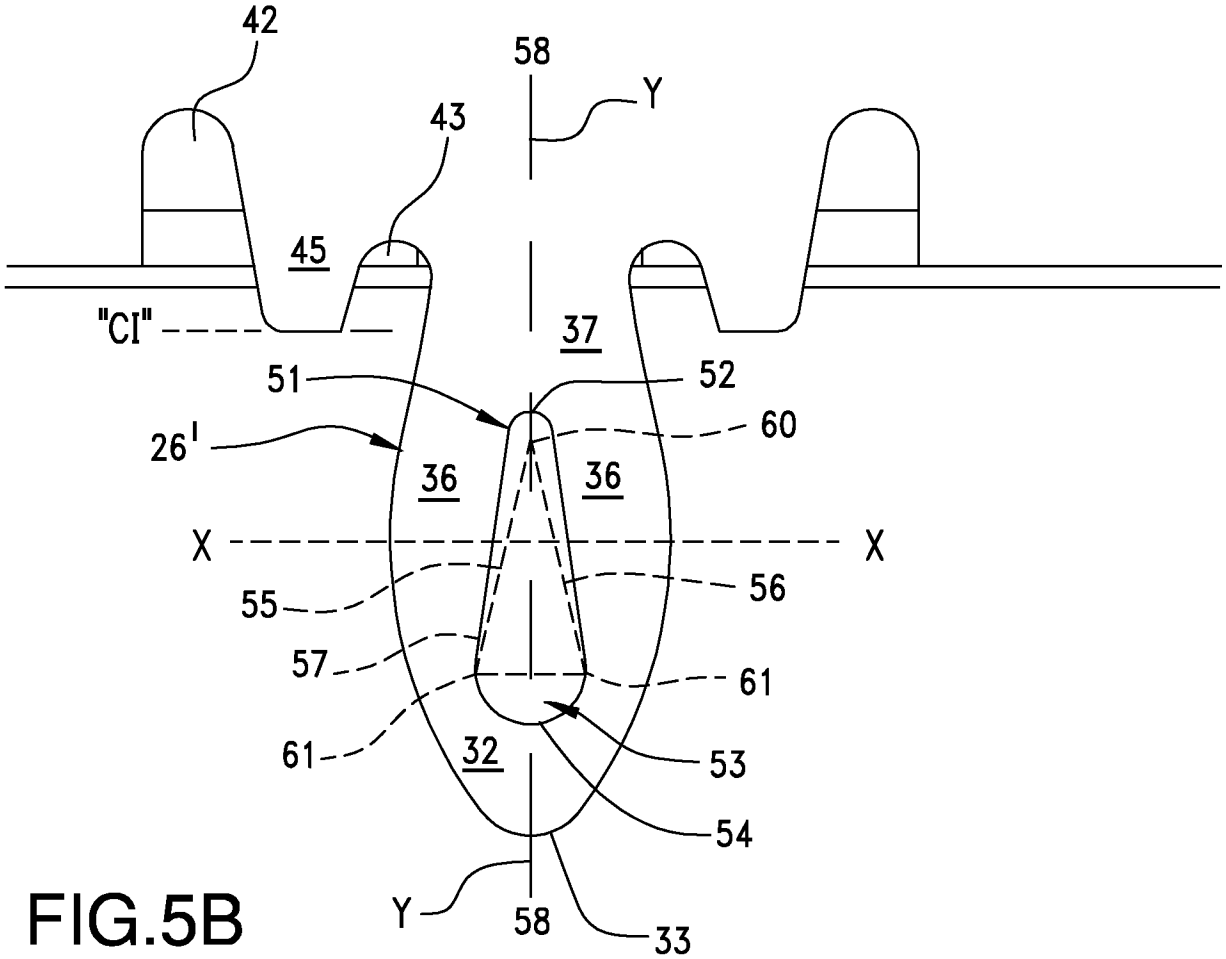
FIG. 5B is an enlarged detail view of FIG. 5A, illustrating a single compliant pin thereof.

Another embodiment of a compliant pin 26' constructed in accordance with the Present Disclosure is illustrated in FIGS. 5A-B, and in this embodiment, not only the pin opening 50 is located below the level of the top surface 22 of the circuit board 21, but also the pin opening 50 has a particular configuration. As illustrated, the pin opening configuration is of a teardrop shape and generally approximates that of an imaginary triangle in that the pin opening 50 has a narrow portion 51 at its top edge 52 thereof and a wide portion 53 near its bottom edge 54 thereof. The triangular shape of the opening 50 generally approximates that of an imaginary isosceles triangle illustrated in FIG. 5B by the dashed line 57, because the sides 55, 56 thereof are equal to each other in length and they extend outwardly equally around a vertical axis Y-Y (58).

The narrow top portion 51 of this pin opening 50 coincides with a top apex 60 of the imaginary triangle, while the widest bottom portions 53 coincide with the bottom apexes 61 of the imaginary triangle.

As such, the pin opening 50 of this embodiment is symmetrical around a vertical axis Y-Y, but asymmetrical around a horizontal axis X-X. Shapes other than that shown may be used provided that the bottom portion of the opening is wider than the top portion.

Figures 6, 7:
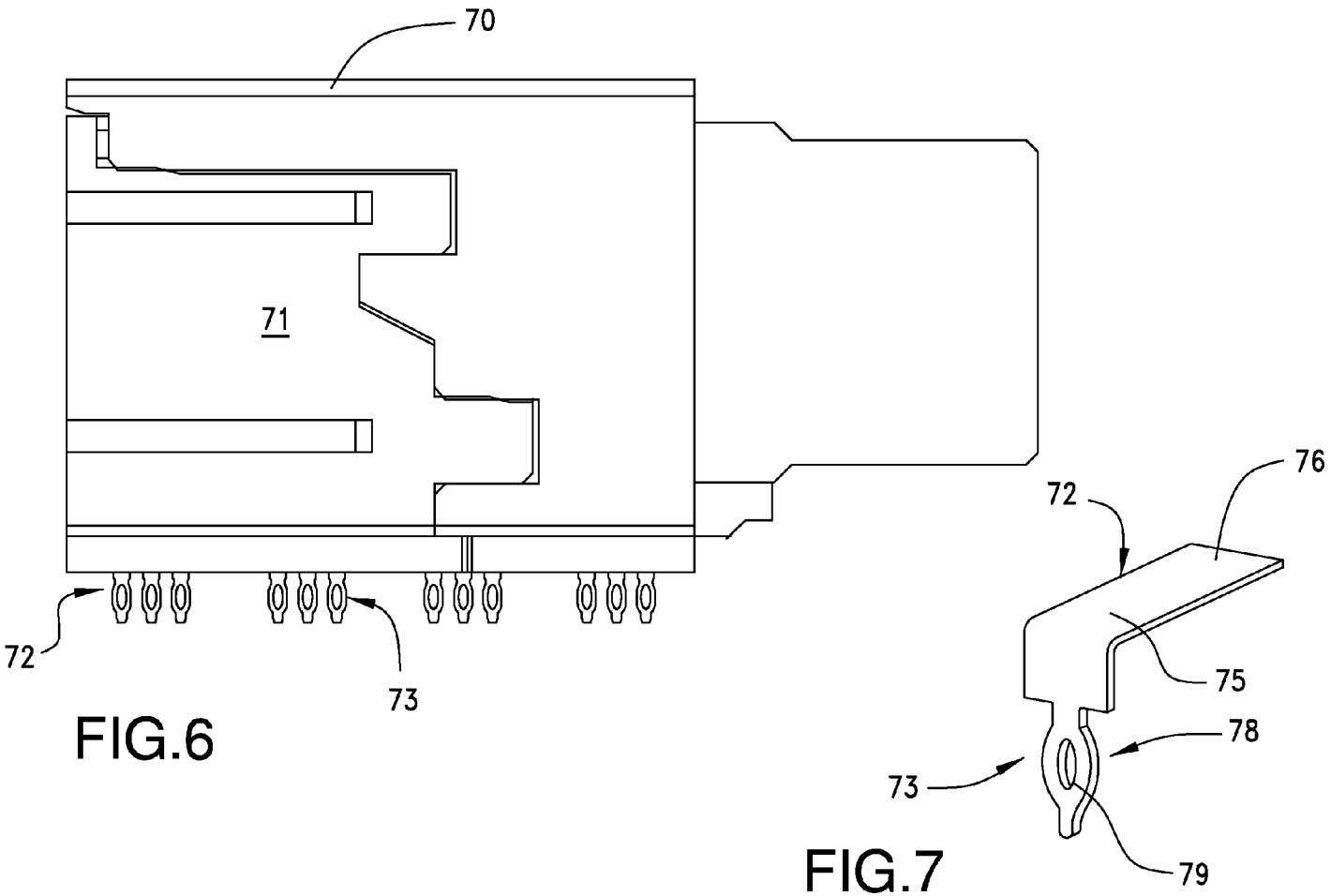
FIG. 6 is a side elevational view of a connector that houses a plurality of terminals with tail portions that incorporate compliant pins of the Present Disclosure.
FIG. 7 is an enlarged view of a connector terminal incorporating a compliant pin tail portion constructed in accordance with the principles of the Present Disclosure.

FIG. 6 illustrates a connector 70 with a housing 71 that supports a plurality of conductive terminals 72 therein. The terminals 72 have tail portions 73 that incorporate compliant pins 74 constructed in accordance with the Present Disclosure. As shown in FIG. 7, the terminals 72 typically include an elongated body portion 75 that have tail portions 73 at one end thereof and contact portions 76 at the other end thereof. The tail portions 73 include complaint pin portions 78 with pin openings 79, teardrop or other shape that are located beneath the terminal-circuit board interface CI.

While a preferred embodiment of the Present Disclosure is shown and described, it is envisioned that those skilled in the art may devise various modifications without departing from the spirit and scope of the foregoing Description and the appended Claims.

What is claimed is:

1. A connector comprising:

a connector housing;

a plurality of conductive terminals, each terminal being supported by the connector housing, each terminal including a terminal mating portion disposed at one end thereof for mating to a terminal of an opposing connector, a terminal mounting portion disposed at an opposite end thereof for insertion into a hole disposed in a circuit board, and a terminal body portion interconnecting the terminal mating and terminal mounting portions together, at least one of the terminal mounting portions including a compliant pin, each compliant pin including:

a pin base portion, a pin tip portion, the pin tip portion being interconnected to the pin base portion by a pin body portion, and a pin opening, the pin opening being disposed in the pin body portion, the pin opening having a top end and a bottom end and extending lengthwise within the pin body portion such that the top end is situated beneath a top surface of the circuit board when the connector is mounted to the circuit board; and a plurality of standoff portions, each standoff portion flanking one compliant pin and extending in the same direction as the compliant pin, each standoff portion including a bottom edge that defines an interface extending along a lower edge of the housing for contacting the circuit board, and the pin opening top end being disposed beneath the interface when mounted to the circuit board.

2. The connector according to claim 1, wherein the pin opening has a non-symmetrical configuration along a horizontal axis of the pin body portion.

3. The connector according to claim 2, wherein the pin opening has a symmetrical configuration along a lengthwise axis of the pin body portion.

4. The connector according to claim 1, wherein the pin opening includes a narrow portion proximate the top end and a wide portion proximate the bottom opening.

5. The connector according to claim 1, wherein each terminal mounting portion is staggered along a mounting surface of the connector.

6. The connector according to claim 1, wherein the connector is a receptacle connector and the housing includes a slot disposed in a mating surface thereof for receiving a mating blade of an opposing connector, the slot being offset from the terminal mounting portions.

7. The connector according to claim 1, further including first notches separating the standoff portions from the compliant pin base portion and second notches spaced apart from the first notches, the interfaces extending between pairs of first and second notches.

8. A shielding cage housing an electrical connector, the shielding cage comprising:

a plurality of walls, the shielding cage walls being interconnected together to define a hollow interior space and configured to receive the electrical connector therein;

a plurality of mounting members, each mounting member being formed as part of and depending down from at least one of the shielding cage walls, each mounting member including a compliant pin, at least one compliant pin including a pin base portion and a pin tip portion interconnected by a pin body portion, at least a pair of slots flanking the pin base portion and spacing the pin base portion apart from the shielding cage wall, the pin body portion including a pin opening disposed therein, the pin opening having a top end and a bottom end and extending lengthwise within the pin body portion such that, in operation the pin opening top end is beneath a top surface of a circuit board when the connector is mounted to the circuit board; and a plurality of standoff portions, each standoff portion being formed as part of and disposed along the shielding cage walls and pairs of standoff portions flanking the pin base portions of each complaint pin, each standoff portion defining an interface extending along a lower edge thereof that is configured to contact the circuit board, and the pin opening top end being disposed beneath the interface when mounted to the circuit board.

9. The shielding cage according to claim 8, wherein each standoff portion is separated from the pin base portion by vertical reentrant notches disposed in the cage sidewalls and flanking the pin base portion.

10. The shielding cage according to claim 8, wherein the pin opening is symmetrical.

11. The shielding cage according to claim 8, wherein the pin opening has a configuration that is symmetrical around a lengthwise axis of the pin body portion.

12. The shielding cage according to claim 11, wherein the pin opening has a configuration that is non-symmetrical around a horizontal axis of the pin body portion.

13. The shielding cage according to claim 8, wherein the pin opening has a preselected height and a plurality of different widths, the width increasing from a first width, proximate the pin body opening top end, to a second width, proximate a centerline of the pin opening height.

14. The shielding cage according to claim 8, further comprising a plurality of compliant pins disposed along two edges thereof, the compliant pins along one edge of the shielding cage being staggered with respect to the compliant pins disposed along the other of the two edges.

15. The shielding cage according to claim 8, wherein each of the compliant pin body portions extend in a first direction and the pairs of standoff portions flanking the compliant pin body portions also extend in the first direction and are further generally parallel to the compliant pin body portions.

16. The shielding cage according to claim 8, wherein the shielding cage walls include a plurality of first and second notches, the first notches being disposed on one side of the standoff portions and the second notches being disposed on the other side of the standoff portions, the first notches separating the standoff portions from the compliant pins and the second notches separating the standoff portions from the shielding cage.

17. The shielding cage according to claim 15, wherein the shielding cage walls include a plurality of first and second notches, the first notches being disposed on one side of the standoff portions and the second notches being disposed on the other side of the standoff portions, the first notches separating the standoff portions from the compliant pins and the second notches separating the standoff portions from the shielding cage walls, and the first and second notches extending in directions the first direction.

18. The shielding cage according to claim 8, wherein the second notches separate the standoff portions from the shielding cage walls.

19. The shielding cage according to claim 8, wherein each compliant pin opening has a first width near its top end and a second width near its bottom end, the second width being greater than the first width.

20. The shielding cage according to claim 19, wherein the compliant pin opening has a configuration that approximates an imaginary triangle with three apexes, one of the apexes being disposed at the top end, and the other two apexes being disposed near the bottom end.

* * * * *